US008515324B2

(12) United States Patent
Ishii et al.

(10) Patent No.: US 8,515,324 B2
(45) Date of Patent: Aug. 20, 2013

(54) FIXING DEVICE AND IMAGE FORMING APPARATUS EMPLOYING THE FIXING DEVICE

(75) Inventors: Kenji Ishii, Kawasaki (JP); Naoki Iwaya, Chofu (JP); Akira Shinshi, Machida (JP); Kenichi Hasegawa, Atsugi (JP); Hiroshi Yoshinaga, Ichikawa (JP); Yoshiki Yamaguchi, Sagamihara (JP); Yutaka Ikebuchi, Chigasaki (JP); Ippei Fujimoto, Ebina (JP); Shuntaroh Tamaki, Kawasaki (JP); Tetsuo Tokuda, Kawasaki (JP); Toshihiko Shimokawa, Zama (JP); Masaaki Yoshikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 218 days.

(21) Appl. No.: 12/923,176

(22) Filed: Sep. 8, 2010

(65) Prior Publication Data

US 2011/0058866 A1 Mar. 10, 2011

(30) Foreign Application Priority Data

Sep. 8, 2009 (JP) ..... 2009-206937

(51) Int. Cl.
*G03G 15/20* (2006.01)

(52) U.S. Cl.
USPC ..... 399/329

(58) Field of Classification Search
USPC ..... 399/329, 331
See application file for complete search history.

(56) References Cited

U.S. PATENT DOCUMENTS

| | | | | |
|---|---|---|---|---|
| 7,079,802 | B2 * | 7/2006 | Katayanagi et al. | 399/331 |
| 2004/0151515 | A1 * | 8/2004 | Nakayama | 399/67 |
| 2004/0156660 | A1 * | 8/2004 | Fuma et al. | 399/328 |
| 2007/0223977 | A1 | 9/2007 | Matsubara et al. | |
| 2009/0067869 | A1 | 3/2009 | Toyonori et al. | |

FOREIGN PATENT DOCUMENTS

| | | | |
|---|---|---|---|
| JP | 04-001681 | A | 1/1992 |
| JP | 2884714 | B2 | 2/1992 |
| JP | 3298354 | B2 | 10/1996 |
| JP | 10213984 | A | 8/1998 |
| JP | 2001282041 | A | 10/2001 |
| JP | 2002268344 | A | 9/2002 |

(Continued)

OTHER PUBLICATIONS

English language abstract for JP-04-044075 published Feb. 13, 1992 (which corresponds to JP-2884714-B2).

(Continued)

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

A fixing device includes an endless, rotatable fixing member, a rotational pressing member, a nip formation member, and an urging unit. The rotational pressing member is rotatably provided in contact with the fixing member. The nip formation member is disposed opposite the rotational pressing member via the fixing member to form a fixing nip between the fixing member and the rotational pressing member. The urging unit is disposed opposite the rotational pressing member via the nip formation member and the fixing member to push against and deform the nip formation member to change a curvature of a contact face between the fixing member and the rotational pressing member at the fixing nip.

12 Claims, 6 Drawing Sheets

(56) References Cited

FOREIGN PATENT DOCUMENTS

| | | | | |
|---|---|---|---|---|
| JP | 2004258484 | A | | 9/2004 |
| JP | 2004264648 | A | | 9/2004 |
| JP | 2005221719 | A | * | 8/2005 |
| JP | 2007171749 | A | | 7/2007 |
| JP | 2007256875 | A | | 10/2007 |
| JP | 2007334205 | A | | 12/2007 |
| JP | 2008122992 | A | | 5/2008 |
| JP | 2008146010 | A | | 6/2008 |
| JP | 2008158482 | A | | 7/2008 |
| JP | 2009009117 | A | | 1/2009 |
| JP | 2010230774 | A | | 10/2010 |

OTHER PUBLICATIONS

English language abstract for JP-08262903 published Oct. 11, 1996 (which corresponds to JP-3298354-B2).

Japanese Office Communication dated May 21, 2013 for corresponding Japanese Application No. 2009-206937.

* cited by examiner

FIXING DEVICE AND IMAGE FORMING APPARATUS EMPLOYING THE FIXING DEVICE

CROSS-REFERENCE TO RELATED APPLICATIONS

The present patent application claims priority pursuant to 35 U.S.C. §119 from Japanese Patent Application No. 2009-206937, filed on Sep. 8, 2009 in the Japan Patent Office, which is incorporated herein by reference in its entirety.

BACKGROUND OF THE DISCLOSURE

1. Field of the Disclosure

Exemplary embodiments of the present disclosure relate to a fixing device and an image forming apparatus including the fixing device, and more specifically, to a fixing device that applies heat and pressure to a recording medium at a nip formed between a fixing member and a pressing member to fix an image on the recording medium, and an image forming apparatus including the fixing device.

2. Description of the Background

As one type of image forming apparatus, electrophotographic image forming apparatuses are widely known. In an image formation process executed by an electrophotographic image forming apparatus, for example, a charger uniformly charges a surface of an image carrier (e.g., photoconductor drum); an optical writing unit directs a light beam onto the charged surface of the image carrier to form an electrostatic latent image on the image carrier according to image data; a development device supplies toner to the electrostatic latent image formed on the image carrier to make the electrostatic latent image visible as a toner image; the toner image is either directly transferred from the image carrier onto a recording medium or indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device may be either a belt-type fixing device or a film-type fixing device. FIG. 1 shows a schematic configuration of a conventional belt-type fixing device. In FIG. 1, the belt-type fixing device includes a heating roller 202, a fixing roller 203, a fixing belt 204, and a pressing roller 205. The heating roller 202 includes a heater 201. The fixing roller 203 includes a rubber layer on its surface. The fixing belt 204 is stretched between and wound around the heating roller 202 and the fixing roller 203. The pressing roller 205 presses against the fixing roller 203 via the fixing belt 204 to form a fixing nip N through which a recording medium passes.

More specifically, to transfer a toner image onto a sheet of recording medium P, the recording medium P is conveyed to the fixing nip N between the fixing belt 204 and the pressing roller 205. When the recording medium P passes through the fixing nip N, heat and pressure are applied to the toner image on the recording medium P to fix the toner image on the recording medium P.

By contrast, FIG. 2 shows a schematic configuration of a conventional film-type fixing device. As described in JP-H04-044075-A, typically, a ceramic heater 211 and a pressing roller 212 together sandwich a heat-resistant film 213, which is the functional equivalent of the fixing belt described above, to form the fixing nip N. A recording sheet is fed to the fixing nip N between the heat-resistant film 213 and the pressing roller 212. Then, the recording sheet is sandwiched by the heat-resistant film 213 and the pressing roller 212 to be conveyed together with the heat-resistant film 213.

Further, the film-type fixing device may be an on-demand type fixing device, including a ceramic heater and a film member of low heat capacity. In an image forming apparatus including the fixing device, the ceramic heater is turned on only during image formation to generate heat at a certain fixing temperature to shorten a waiting time required to reach to a state ready for image formation from activation of the image forming apparatus, thereby reducing power consumption in a standby mode.

Further, a conventional pressing-belt-type fixing device like that described in JP-H08-262903-A includes a thermal fixing roller, an endless belt, and a pressing pad. The thermal fixing roller is rotatable and has an elastically deformable surface. The endless belt travels in contact with the thermal fixing roller. The pressing pad is fixedly mounted inside a loop formed by the endless belt and presses the endless belt against the thermal fixing roller to form a belt nip between the endless belt and the thermal fixing roller through which the recording medium passes.

According to the pressing-belt-type fixing device described above, pressure of the pressing pad against the endless belt elastically deforms the surface of the thermal fixing roller and enlarges a contact area of the thermal fixing roller and the recording medium to enhance heat conduction efficiency, reduce energy consumption, and achieve a more compact design.

However, for example, in the above-described film-type fixing device described in JP-H04-044075-A, there is room for improvement in durability and temperature stability of the fixing belt.

For example, the fixing belt is made of heat-resistant film and is abrasion-resistant. However, since the fixing belt slides over the ceramic heater as the fixing belt rotates, the fixing belt tends to get worn out when driven for an extended period of time. Accordingly, rotation of the fixing belt may become unsteady and/or the driving torque required by the fixing device may increase, neither of which is desirable. Consequently, the recording medium may slip on the fixing belt, causing displacement of a resultant image. Alternatively, a driving gear may be subjected to increased stress, causing damage to the gear.

Further, in the film-type fixing device, the fixing belt is heated locally, that is, only at the fixing nip. As a result, the temperature of the fixing belt is at its lowest when the fixing belt in rotation returns to an entrance of the fixing nip, causing faulty fixing, particularly at high-speed rotation.

To reduce the friction between the fixing belt and the ceramic heater or other stationary members, for example, JP-H08-262903-A describes a fixing device using a fiberglass sheet (PTFE impregnated glass cloth) impregnated with polytetrafluoroethylene (PTFE) as a low-friction sheet (a sheet-shaped slide member) as a surface layer of the pressing pad.

However, in the above-described pressing-belt-type fixing device, a large heat capacity of the fixing roller may increase the time required for raising the temperature of the fixing roller to the required level, thereby extending the warm-up time.

Hence, techniques like those described in JP-2007-334205-A and P-2008-158482-A are proposed to meet such challenges. However, although successful at shortening the warm-up time, such fixing devices are susceptible to new problems caused by a difference in temperature (a temperature differential) between the fixing member and the pressing member.

Specifically, in such fixing devices, the temperature of the fixing member rises more quickly than the temperature of the pressing member does. Consequently, a temperature differential arises between opposed front and back faces of the recording sheet passing through the fixing nip may occur, causing curling of the recording sheet. In other words, a difference in the moisture content evaporated from the front and back faces of the recording sheet may cause curling of the recording sheet.

Further, the inventors of the present disclosure have found that such curling of the recording sheet might also be caused by the shape (e.g., curvature) of the fixing nip as well as the above-described temperature differential between the front and back faces of the recording sheet.

SUMMARY

In at least one exemplary embodiment, there is provided an improved fixing device including an endless, rotatable fixing member, a rotational pressing member, a nip formation member, and an urging unit. The rotational pressing member is rotatably provided in contact with the fixing member. The nip formation member is disposed opposite the rotational pressing member via the fixing member to form a fixing nip between the fixing member and the rotational pressing member. The urging unit is disposed opposite the rotational pressing member via the nip formation member and the fixing member to push against and deform the nip formation member to change a curvature of a contact face between the fixing member and the rotational pressing member at the fixing nip.

In at least one exemplary embodiment, there is provided an improved fixing device including fixing means, pressing means, nip forming means, and urging means. The fixing means fixes an image on a recording medium. The pressing means rotationally presses the fixing member. The nip forming means forms a fixing nip between the fixing means and the pressing means. The urging means pushes the nip forming means. The deformation of the nip formation means pushed by the urging means changes a curvature of a contact face between the fixing means and the pressing means at the fixing nip.

The fixing means fixes an image on a recording medium. The pressing means rotationally presses the fixing member. The nip forming means forms a fixing nip between the fixing means and the pressing means. The urging means presses against and deforming the nip forming means to change a curvature of a contact face between the fixing means and the pressing means at the fixing nip.

In at least one exemplary embodiment, there is provided an improved image forming apparatus including an image forming device that forms an image on a recording medium, a fixing device that fixes the image, formed by the image forming device, on the recording medium, and a heater that heats the fixing device. The fixing device includes an endless, rotatable fixing member, a rotational pressing member, a nip formation member, and an urging unit. The rotational pressing member is rotatably provided in contact with the fixing member. The nip formation member is disposed opposite the rotational pressing member via the fixing member to form a fixing nip between the fixing member and the rotational pressing member. The urging unit is disposed opposite the rotational pressing member via the nip formation member and the fixing member to push against and deform the nip formation member to change a curvature of a contact face between the fixing member and the rotational pressing member at the fixing nip.

BRIEF DESCRIPTION OF THE DRAWINGS

Additional aspects, features, and advantages will be readily ascertained as the same becomes better understood by reference to the following detailed description when considered in connection with the accompanying drawings, wherein.

Figure 1:
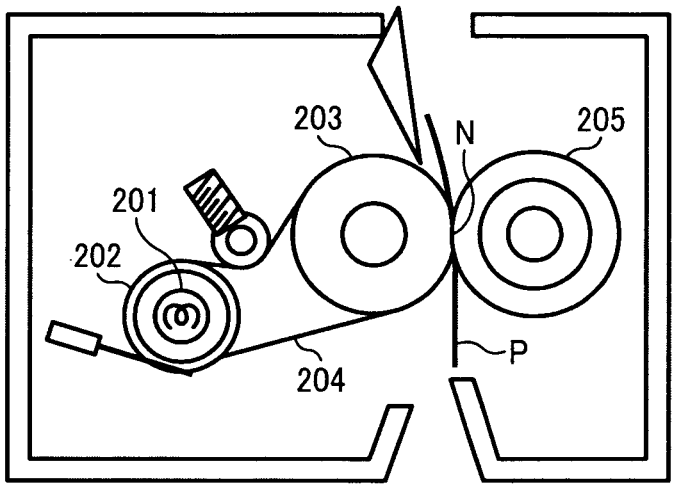
FIG. 1 RELATED ART
FIG. 1 is a schematic configuration of a conventional type of fixing device.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

It is to be noted that, in the description below, suffixes Y, M, C, and K attached to reference numerals indicate only that components indicated thereby are used for forming yellow, magenta, cyan, and black images, respectively, and hereinafter may be omitted when color discrimination is not necessary.

Referring now to the drawings, wherein like reference numerals designate identical or corresponding parts throughout the several views, in particular to FIG. 3, an image forming apparatus 1 according to an exemplary embodiment of the present disclosure is described below.

Figure 3:
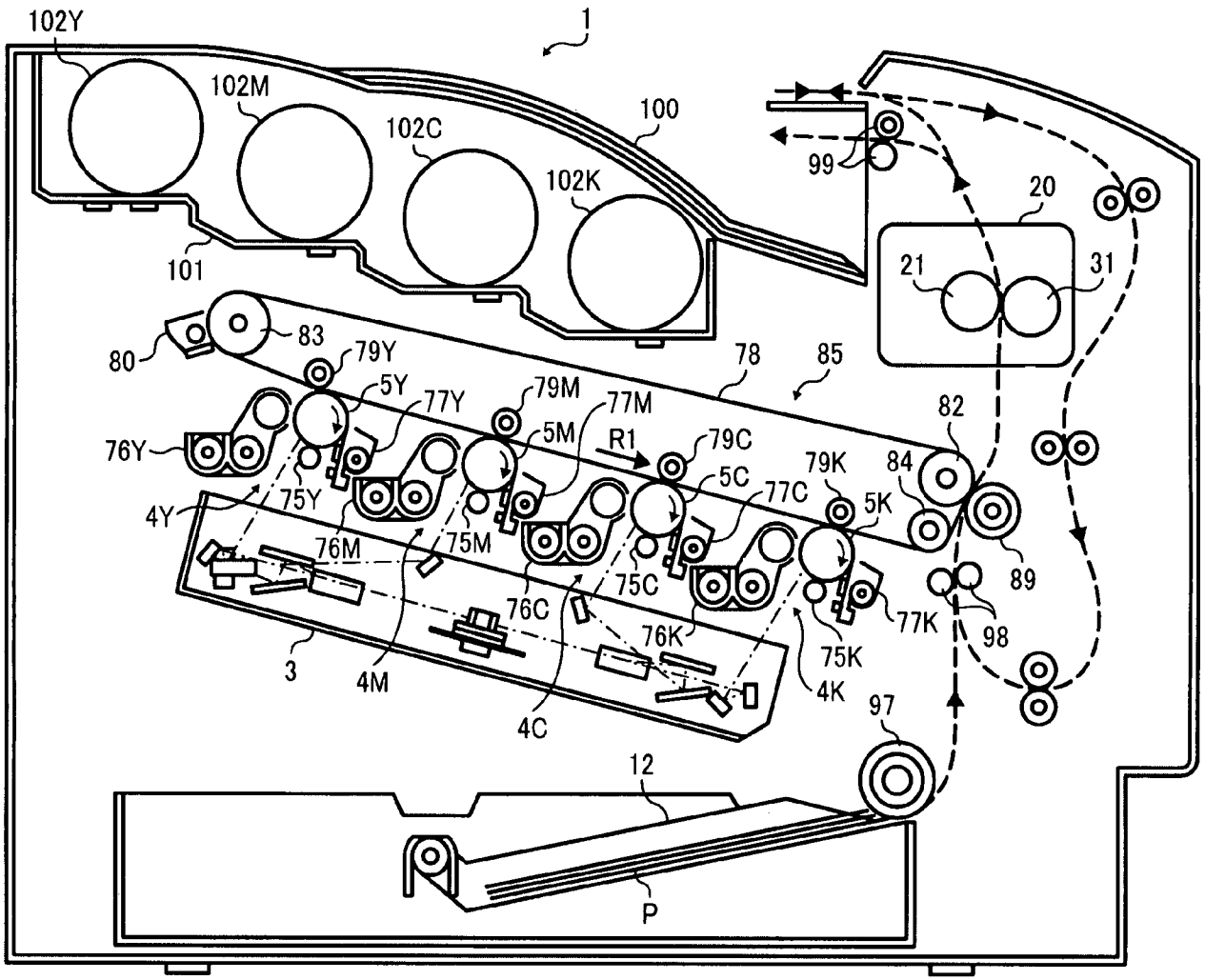
FIG. 3 is a schematic elevation view illustrating an image forming apparatus according to an exemplary embodiment of the present disclosure.

FIG. 3 is a schematic elevation view illustrating a configuration of the image forming apparatus 1 according to exemplary embodiments of the present disclosure.

In FIG. 3, the image forming apparatus 1 is illustrated as a tandem color printer for forming a color image on a recording medium. However, it is to be noted that the image forming apparatus 1 may be a copier, a facsimile machine, a printer, a multifunctional peripheral having at least two of copying, printing, scanning, plotter, facsimile capabilities, and the like.

As illustrated in FIG. 3, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K. The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively.

Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 3. In the charging process, the chargers 75Y, 75M, 75C, and 75K are disposed opposite the photoconductive drums 5Y, 5M, 5C, and 5K, respectively, and uniformly charge surfaces of the photoconductive drums 5Y, 5M, 5C, and 5K.

In the exposure process, the exposure device 3 emits laser beams L onto the charged surfaces of the photoconductive drums 5Y, 5M, 5C, and 5K to expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78 at the first transfer nips formed between the photoconductive drums 5Y, 5M, 5C, and 5K and the intermediate transfer belt 78. Thus, a color toner image is formed on the intermediate transfer belt 78.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process.

After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

In this regard, the recording medium P is fed from the paper tray 12 to the second transfer nipping position via the feed roller 97 and the registration roller pair 98.

The paper tray 12 is provided in a lower portion of the image forming apparatus 1, and loads a plurality of recording media P (e.g., transfer sheets).

The feed roller 97 rotates counterclockwise in FIG. 3 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily.

The registration roller pair 98 resumes rotating to feed the recording medium P to the second transfer nip, formed between the second transfer roller 89 and the intermediate transfer belt 78, as the color toner image formed on the intermediate transfer belt 78 reaches the second transfer nip. Thus, the color toner image is transferred on the recording medium P.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
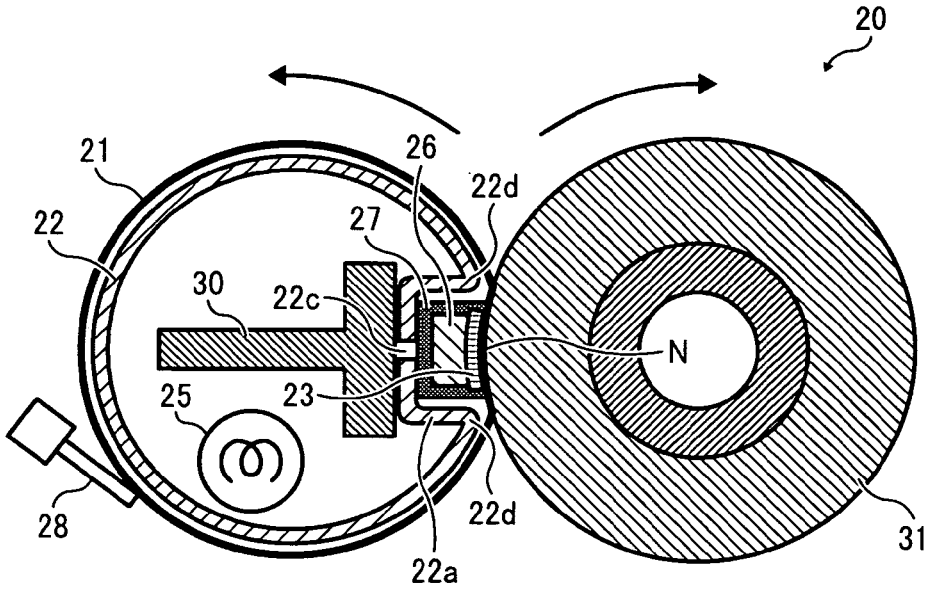
FIG. 4 is a cross-sectional elevation view illustrating a fixing device according to a first exemplary embodiment.

FIG. 4 is a cross-sectional elevation view illustrating the fixing device 20 according to a first exemplary embodiment of the present disclosure.

In FIG. 4, the fixing device 20 includes the fixing belt 21, a stationary heat conductive member 22, a halogen heater 25, a thermistor 28, an urging unit 30, and a pressing roller 31. The fixing belt 21 is an endless belt member serving as a fixing member. The heat conductive member (supporting member) 22 has a pipe shape and is disposed inside a loop formed by the fixing belt 21. The heat conductive member 22 conducts heat to the fixing belt 21 and supports the fixing belt 21 as a supporting member, insofar as the fixing belt 21 is looped, wrapped, or fitted around the outside of the heat conductive member 22. The halogen heater 25 is a heating member, and the thermistor 28 is a temperature sensor in contact with the fixing belt 21 to detect a surface temperature of the fixing belt 21. The pressing roller 31 is a pressing member disposed in contact with the fixing belt 21 to form a fixing nip N.

The heat conductive member 22 includes a recessed portion 22*a* opposite the fixing nip N. At the recessed portion 22*a* are disposed a nip formation member 26, a lubrication sheet 23 of, e.g., a mesh type interposed between the fixing belt 21 and the nip formation member 26, and a heat insulator 27 between the nip formation member 26 and a bottom of the recessed portion 22*a*.

The nip formation member 26 is formed of an elastic material, such as silicone rubber or fluorocarbon rubber. An inner surface of the fixing belt 21 indirectly slides over the nip formation member 26 via the lubrication sheet 23. Alternatively, the inner surface of the fixing belt 21 may directly slide over the nip formation member 26.

It is to be noted that the recessed portion 22*a* of the heat conductive member 22 is not limited to the recessed shape described above and may be a flat shape or any other suitable shape. However, the recessed shape forces the leading edge of the recording medium P toward the pressing roller 31 as the recording medium P exits the fixing nip N, which allows the recording medium P to more easily separate from the fixing belt 21, thereby preventing sheet jam.

The pressing roller 31 includes a hollow metal roller having a silicone rubber layer. A releasing layer, such as a perfluoroalkoxy (PFA) resin layer or a polytetrafluoroethylene (PTFE) resin layer, is formed on an outer surface of the pressing roller 31 to obtain good releasing property.

The pressing roller 31 is rotated by a driving force transmitted from a driving source, such as a motor, disposed in the image forming apparatus via a gear train. Further, the pressing roller 31 is pressed against the fixing belt 21 by a spring or other, similar member. As a result, the rubber layer of the pressing roller 31 is squashed and deformed to form a certain width of the fixing nip N.

It is to be noted that the pressing roller 31 may be formed of a solid roller. However, a hollow roller is preferable in that the heat capacity is relatively small. In addition, the pressing roller 31 may include a heat source such as a halogen heater.

The silicone rubber layer of the pressing roller 31 may be solid rubber. Alternatively, if a heat source, such as a heater, is not provided in the pressing roller 31, the silicone rubber layer may be made of sponge rubber. Sponge rubber is preferable in that the insulation performance is relatively high and thus less of the heat of the fixing belt 21 is transmitted to the pressing roller 31.

The fixing belt 21 is an endless belt (or film) including nickel, stainless, or other metal or a polyimide resin or other resin. The fixing belt 21 has a releasing layer, such as a PFA resin layer or a PTFE resin layer, on its surface to prevent toner on the recording medium from adhering to the fixing belt 21.

A silicone rubber layer or other elastic layer may be formed between the substrate of the fixing belt 21 and the PFA (or PTFE) resin layer. If the silicone rubber layer is not provided, the heat capacity of the fixing belt 21 is relatively small, enhancing the fixing performance. However, when an unfixed toner image is compressed by the surface of fixing belt 21, minute irregularities in the surface of the fixing belt 21 may be transferred to the toner image. To prevent such an occurrence, the silicone rubber layer may be formed with a thickness of, e.g., 100 um or more. Deformation of the silicone rubber layer can absorb such minute irregularities, preventing formation of an irregular toner image.

The heat conductive member 22 has a pipe shape and includes a metal such as aluminum, iron, and/or stainless steel. The heat conductive member 22 according to the present exemplary embodiment has a diameter which is, e.g., 1 mm smaller than a diameter of the fixing belt 21 when the fixing belt 21 is formed into a loop around the heat conductive member 22. In this regard, it is to be noted that the cross-sectional shape of the fixing belt 21, that is, the shape into which it is formed, is not limited to the circular shape and may be a rectangular shape.

The nip formation member 26 and the heat insulator 27 are installed in the recessed portion 22*a* of the heat conductive member 22. The urging unit 30 is provided inside the heat conductive member 22 to support the recessed portion 22*a*, the nip formation member 26, and the heat insulator 27.

In such a configuration, the urging unit 30 might be heated by, e.g., radiation heat of the halogen heater 25. In such a case, the surface of the urging unit 30 may be insulated or mirror-finished to prevent heating. Such a configuration can prevent wasteful heat energy consumption.

It is to be noted that the heat source to heat the heat conductive member 22 is not limited to the halogen heater 25 as illustrated in FIG. 4 and may be, e.g., an induction heater. Further, a resistance heater or a carbon heater may be employed.

In the fixing device 20 illustrated in FIG. 4, the fixing belt 21 is heated via the heat conductive member 22. Alternatively, the fixing belt 21 may be directly heated by a heat source.

Figure 2:
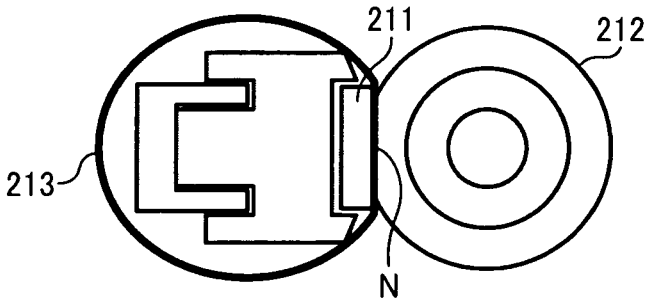
FIG. 2 RELATED ART
FIG. 2 is a schematic configuration of another conventional type of fixing device.

The fixing belt 21 rotates in accordance with rotation of the pressing roller 31. In FIG. 2, the pressing roller 31 is rotated by a drive source, and the drive force of the pressing roller 31 is transmitted to the fixing belt 21 at the fixing nip N to rotate the fixing belt 21.

The fixing belt 21 rotates between the nip formation member 26 and the pressing roller 31, which together sandwich the fixing belt 21 at the fixing nip N. The fixing belt 21 is further guided in its rotation by the heat conductive member 22 in an area other than the fixing nip N, thus preventing the fixing belt 21 from moving away from the heat conductive member 22 beyond a certain distance.

Lubricant, such as silicone oil or fluorine grease, is applied to an interface between the fixing belt 21 and the heat conductive member 22. The surface roughness of the heat conductive member 22 is set to be not less than a particle diameter of the lubricant, facilitating retention of the lubricant on the surface of the heat conductive member 22.

The method of roughening the surface of the heat conductive member 22 may involve physical processing, such as sandblasting, or chemical processing, such as etching. Alternatively, coating material including small-diameter beads may be applied to the surface of the heat conductive member 22.

In the first exemplary embodiment, the urging unit 30 is provided within the heat conductive member 22 to push the recessed portion 22*a* of the heat conductive member 22 toward the fixing nip N. The urging unit 30 pressingly deforms the nip formation member 26, which is an elastic member, thus allowing the clearance and shape of the fixing nip N to be adjusted. Such adjustment using the urging unit 30 is performed in accordance with a condition of the recording medium P conveyed to the fixing device 20 by a driving unit or a temperature condition of the fixing nip N.

Figure 5:
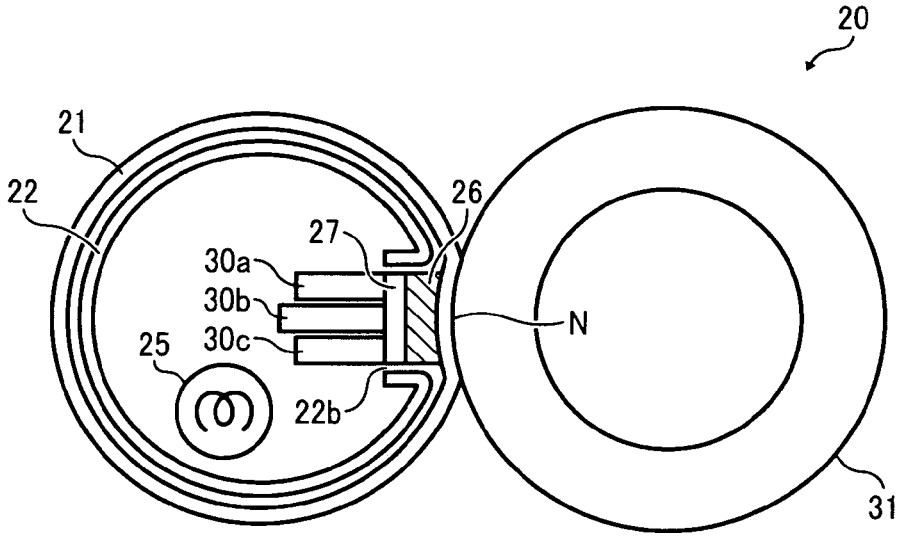
FIG. 5 is a cross-sectional elevation view illustrating a fixing device according to a second exemplary embodiment.
Figure 6:
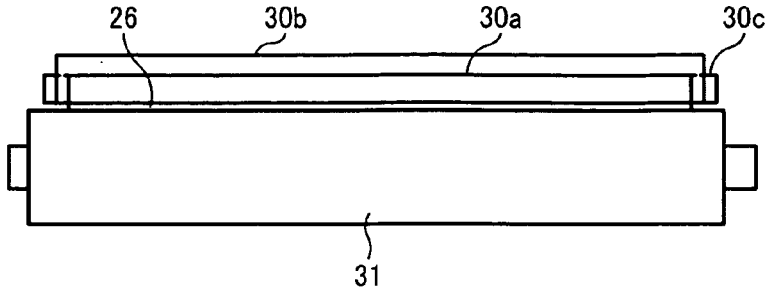
FIG. 6 is a side view illustrating the fixing device illustrated in FIG. 5.

FIG. 5 is a cross-sectional elevation view illustrating a portion of a fixing device 20 according to a second exemplary embodiment of the present disclosure. FIG. 6 is a side view illustrating the fixing device 20 illustrated in FIG. 5. In the following description, the same reference characters are allocated to members corresponding to those described above and redundant descriptions thereof are omitted below.

In the second exemplary embodiment, an opening portion 22*b* is provided at a position facing the fixing nip N. The nip formation member 26 and the heat insulator 27 are provided within the opening portion 22*b*. A plurality of urging members 30*a*, 30*b*, and 30*c* is provided to push the nip formation member 26 via the heat insulator 27. In FIG. 5, three urging members 30*a*, 30*b*, and 30*c* are illustrated as the urging unit 30. However, the number of urging members in the urging unit 30 is not limited to three but may be any other suitable number.

The nip formation member 26 may be made of silicon rubber, fluorocarbon rubber, or other elastic material. One side of the nip formation member 26 proximal to the pressing roller 31 has a curved face having a curvature approximately equal to a curvature of the outer diameter of the pressing roller 31 and is supported by the opening portion 22*b* via the heat insulator 27 so as to be movable toward the pressing roller 31.

The pressing roller 31 is pressed against the nip formation member 26 using a biasing member, e.g., a spring, to form a fixing nip between the pressing roller 31 and the fixing belt 21.

The other side of the nip formation member 26 distal to the pressing roller 31 is supported by the urging members 30*a*, 30*b*, and 30*c* so as not to be moved by the pressure of the pressing roller 31. In the first exemplary embodiment described above, the nip formation member 26 is supported by the single urging member. In the second exemplary embodiment, the nip formation member 26 is supported by the three urging members 30*a*, 30*b*, and 30*c*.

Each of the urging members 30*a*, 30*b*, and 30*c* extends parallel to an axial direction of the pressing roller 31 and is positioned so as to receive the pressure of the pressing roller 31 to support the nip formation member 26.

In FIG. 5, the urging members 30*a*, 30*b*, and 30*c* have different lengths. However, it is to be noted that the urging members 30*a*, 30*b*, and 30*c* may have the same length or any other suitable length, so long as the length is not less than the maximum width of usable recording media that the fixing device can accommodate.

As illustrated in FIG. 5, each of the urging members 30*a*, 30*b*, and 30*c* separately supports the nip formation member 26. For example, in a configuration in which a recording medium is conveyed from a lower position in FIG. 5, the urging member 30*c* is disposed near the entrance of the fixing nip N, the urging member 30*b* is disposed at a central portion of the fixing nip N, and the urging member 30*a* is disposed near the exit of the fixing nip N.

The function of the fixing nip N is to melt unfixed toner on a recording medium and apply pressure to the toner to fix the toner on the recording medium. When unfixed toner on the recording medium contacts the fixing belt 21 at the fixing nip. N, heat of the fixing belt 21 is conducted to the unfixed toner on the recording medium. The heat melts the unfixed toner on the recording medium, and the pressure of the nip portion sandwiched between the nip formation member 26 and the pressing roller 31 causes the toner to strongly adhere to the recording medium.

Distribution of the pressure generated at the fixing nip is described with reference to FIG. 9. FIG. 9 is a chart illustrating a distribution of the pressure generated at a portion A of the fixing device 20 illustrated in FIG. 8.

Deformation of the nip formation member 26 typically causes a stress distribution between the pressing roller 31 and the nip formation member 26 like that illustrated in FIG. 9. In the distribution, the pressure is lower near an entrance or exit of the fixing nip N than at a central portion of the fixing nip N. Since the amount of heat applied to toner at the fixing nip N is predetermined, the time (hereinafter, nip-passing time) which the recording medium takes to pass through the fixing nip N is adjusted in accordance with the speed (hereinafter, nip-passing speed) at which the recording medium passes through the fixing nip N. Accordingly, when the recording medium passes through the fixing nip N at higher speed, a wider nip is needed (nip passing time=nip width/nip passing speed).

In such a case, if the curve of the fixing nip N is too sharp, the recording medium might be excessively turned toward the pressing roller 31 at the exit of the fixing nip N. Conversely, if the curve width of the fixing nip N is too small, the recording medium might be ejected curling around the fixing belt 21.

Further, heavy curling of the recording medium or excessive heat applied to toner might cause hot offset or irregular gloss. Alternatively, insufficient heating might cause faulty fixing or cold offset. Further, when a recording medium to which toner does not easily adhere is employed, there might occur a shortage of pressure, causing a failure as described above.

Hence, in the second exemplary embodiment, the positions of the urging members 30*a*, 30*b*, and 30*c* are movable toward the pressing roller 31. Such a configuration allows adjustment of the curvature of the nip portion and the direction in which the recording medium is ejected from the fixing nip N. Further, such a configuration allows, for example, adjustment of the orientation of the fixing nip in accordance with a direction in which the recording medium is curled. Alternatively, if the recording medium curls around the fixing member, the direction in which the recording medium is ejected can be adjusted at the fixing nip.

The urging members 30*a*, 30*b*, and 30*c* are movably supported, for example, by a side plate of the fixing device 20.

Figure 7:
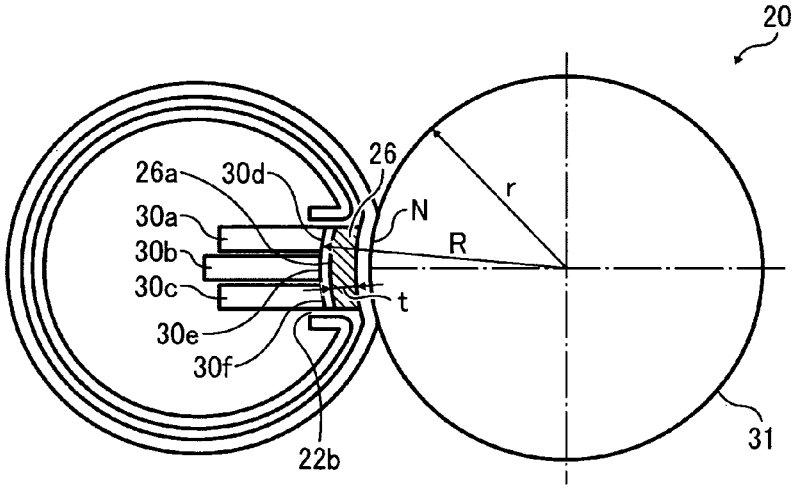
FIG. 7 is a cross-sectional elevation view illustrating a fixing device according to a third exemplary embodiment.

FIG. 7 is a cross-sectional elevation view illustrating a portion of a fixing device 20 according to a third exemplary embodiment. In the third exemplary embodiment, one side of the nip formation member 26 proximal to the urging members 30*a*, 30*b*, and 30*c* has a curvature approximately equal to a curvature of the pressing roller 31.

In the third exemplary embodiment, a curved face 26*a* of the nip formation member 26 has a curvature approximately equal to a curvature of each of curved faces 30*d*, 30*e*, and 30*f* of the urging members 30*a*, 30*b*, and 30*c* proximal to the nip formation member 26, and the thickness of the nip formation member 26 is uniform. Such a configuration allows the pressure of the urging members 30*a*, 30*b*, and 30*c* to create a uniform distribution of stress at the fixing nip N.

Such a configuration can also reduce irregularities in the stress distribution due to deformation of the nip formation member 26 even if the positions of the urging members 30*a*, 30*b*, and 30*c* vary (e.g., due to the positional shift of the urging members for adjusting the shape of the nip formation member 26).

In this regard, the following relation is satisfied: $1/r>1/R>1/(r+t)$ where r represents the radius of the pressing roller 31, R represents the distance between a rotation center of the pressing roller 31 and each of the curve faces 30*d*, 30*e*, and 30*f* of the urging members 30*a*, 30*b*, and 30*c*, *t* represents the thickness of the nip formation member 26, 1/R represents the curvature of each of the curve faces 30*d*, 30*e*, and 30*f* of the urging members 30*a*, 30*b*, and 30*c*, and 1/r represents the curvature of the fixing nip N.

Figure 8:
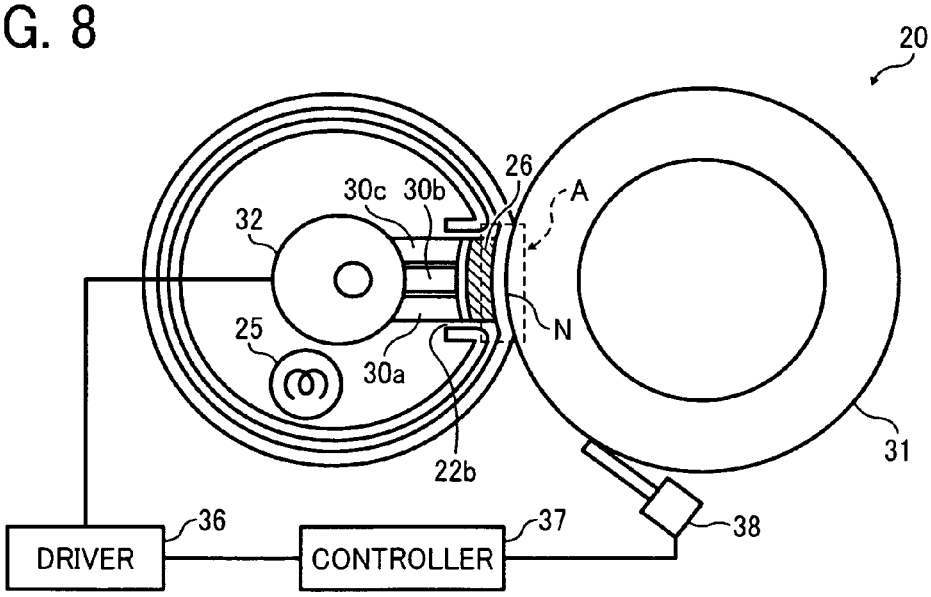
FIG. 8 is a cross-sectional elevation view illustrating a portion of a fixing device according to a fourth exemplary embodiment.
Figure 9:
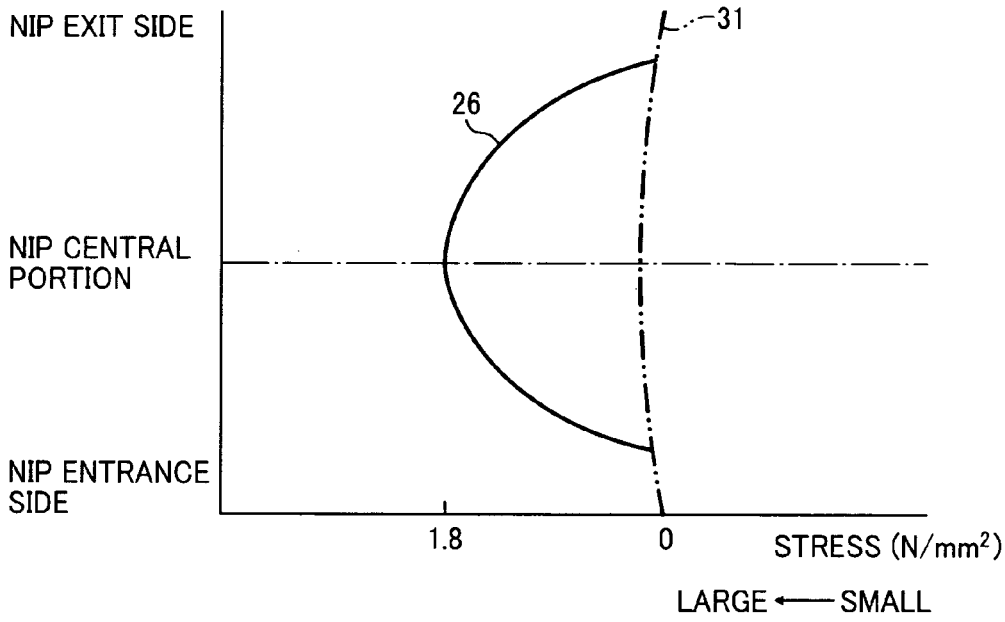
FIG. 9 is a chart illustrating a pressure distribution at a portion A of the fixing device illustrated in FIG. 8.

FIG. 8 is a cross-sectional elevation view illustrating a portion of a fixing device 20 according to a fourth exemplary embodiment of the present disclosure. In FIG. 8, an example of a mechanism for driving the urging members 30*a*, 30*b*, and 30*c* illustrated in FIG. 7 is illustrated.

More specifically, one end of the urging members 30*a*, 30*b*, and 30*c* contacts a cylindrical eccentric cam 32 extending along the urging members 30*a*, 30*b*, and 30*c*. The eccentric cam 32 is rotated by a driver 36.

Rotating the eccentric cam 32 can separately adjust the positions of the urging members 30*a*, 30*b*, and 30*c*. For example, to turn the recording medium toward the pressing roller 31 at the exit of the fixing nip N, the eccentric cam 32 is rotated clockwise in FIG. 8. By contrast, to turn the recording medium toward the fixing belt 21 at the exit of the fixing nip N, the eccentric cam 32 is rotated counterclockwise in FIG. 8. As described above, the driving member adjusts the curvature of the nip formation member 26, preventing the above-described failure.

In the present exemplary embodiment, since a heater is not provided with the pressing roller 31, just after the power is turned on, the rate of temperature rise of the pressing roller 31 is lower than that of the fixing belt 21 heated by the halogen heater 25, causing an elastic layer on the surface of the pressing roller 31 to have higher hardness. Consequently, just after the power is turned on, the recording medium (e.g., a sheet of paper) is oriented toward the pressing roller 31. Then, as the temperature of the pressing roller 31 rises, the orientation of the recording medium is gradually turned back toward the fixing belt 21.

Accordingly, just after the power is turned on, the recording medium might curl around the pressing roller 31 and, as the temperature of the pressing roller 31 rises, the recording medium might curl around the fixing belt 21. Hence, in the present exemplary embodiment, to prevent such curling, the temperature of the pressing roller 31 is detected with a temperature detector 38, and a controller 37 controls the rotation of the eccentric cam 32 via the driver 36 in accordance with the temperature detected by the temperature detector 38. Thus, the positioning of the urging members 30*a*, 30*b*, and 30*c* is adjusted to obtain a proper ejecting direction of the recording medium. Such a configuration can prevent the recording medium from curling around the pressing roller 31 or the fixing belt 21, enhancing the conveyance performance.

Figure 10:
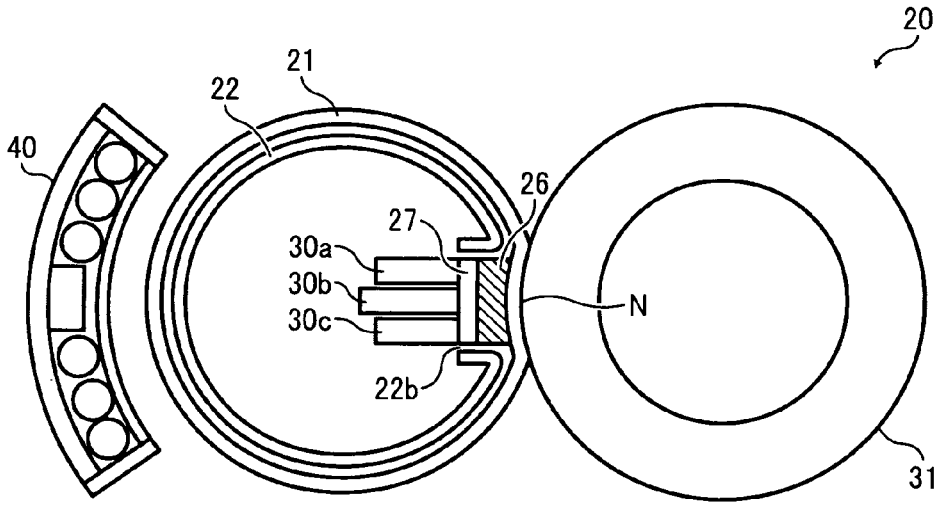
FIG. 10 is a cross-sectional elevation view illustrating a fixing device according to a fifth exemplary embodiment.

FIG. 10 is a fixing device 20 according to a fifth exemplary embodiment of the present disclosure. As illustrated in FIG. 10, the fixing device 20 may include an induction heater 40 instead of the heater 25 (e.g., a halogen heater or a carbon heater). The induction heater 40 is provided outside the loop formed by the fixing belt 21 to face the outer circumferential surface of the fixing belt 21, and serves as a heater for heating the fixing belt 21 by using electromagnetic induction of induction heating (IH).

The induction heater 40 includes an exciting coil, a core, and a coil guide. The exciting coil includes litz wires formed of bundled thin wires and extended in the width direction of the fixing belt 21 to cover a part of the fixing belt 21. The coil guide includes heat-resistant resin and holds the exciting coil and the core. The core is a semi-cylindrical member formed of a ferromagnet (e.g., ferrite) having relative magnetic permeability in a range of from about 1,000 to about 3,000. The core includes a center core and a side core to generate magnetic fluxes toward the heat conductive member 22 effectively. The core is disposed opposite the exciting coil extending in the width direction of the fixing belt 21.

The following describes operation of the fixing device 20 including the induction heater 40 having the above-described structure.

When the fixing belt 21 is rotated, the induction heater 40 heats the fixing belt 21 at a position at which the fixing belt 21 faces the induction heater 40. Specifically, a high-frequency alternating current is applied to the exciting coil to generate magnetic lines of force around the heat conductive member 22 in such a manner that the magnetic lines of force are alternately switched back and forth. Accordingly, an eddy current generates on a surface of the heat conductive member 22, and electric resistance of the heat conductive member 22 generates Joule heat. The Joule heat heats the heat conductive member 22 by electromagnetic induction, and the heat conductive member 22 heated in turn heats the fixing belt 21.

In order to heat the heat conductive member 22 effectively by electromagnetic induction, the induction heater 40 may face the heat conductive member 22 in an entire circumferential direction of the heat conductive member 22. The heat conductive member 22 may include nickel, stainless steel, iron, copper, cobalt, chrome, aluminum, gold, platinum, silver, tin, palladium, an alloy of a plurality of those metals, and/or the like.

Figure 11:
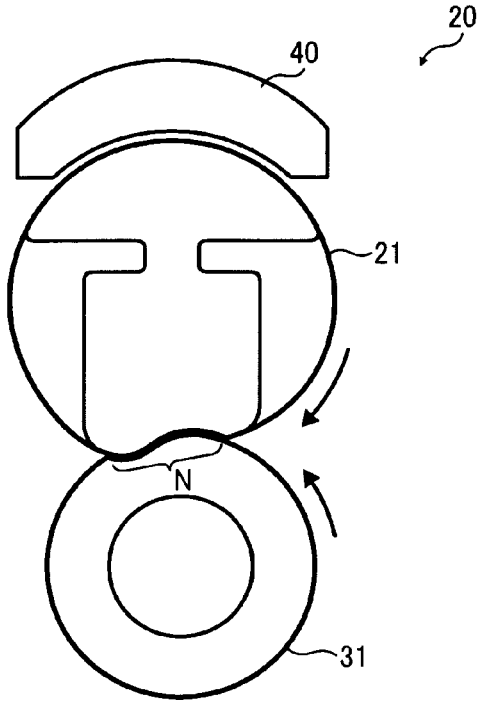
FIG. 11 is a cross-sectional elevation view illustrating a fixing device according to a sixth exemplary embodiment.

As illustrated in FIG. 11, the induction heater 40 may be provided outside the loop formed by the fixing belt 21, and heats the fixing belt 21 via the heat conductive member 22. Alternatively, the induction heater 40 may heat the fixing belt 21 directly.

The fixing belt 21 includes a conductive layer as an inner layer. When magnetic lines of force generated by the induction heater 40 pass over the conductive layer of the fixing belt 21, an eddy current is generated in the conductive layer that generates a magnetic field that prevents change of an alternating magnetic field of the magnetic lines of force. The eddy current flowing in the conductive layer generates Joule heat proportional to the resistance of the conductive layer to heat the fixing belt 21.

In the present exemplary embodiment, the heat conductive member 22 contacts or faces the inner circumferential surface of the fixing belt 21 to support or hold the fixing belt 21 to heat the fixing belt 22. The heat conductive member 22 may be manufactured by bending a thin metal plate into a pipe shape at relatively reduced manufacturing costs, enhancing heating efficiency for heating the fixing belt 21, shortening a warm-up time or a first print time, and suppressing faulty fixing which may occur when the fixing device 20 is driven at high speed.

Figure 12:
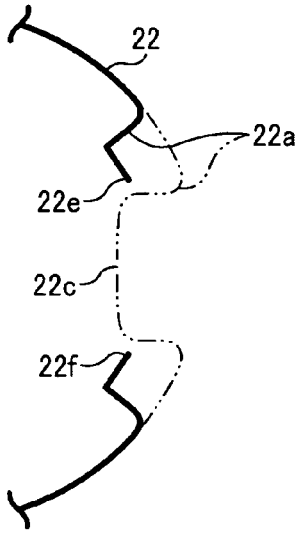
FIG. 12 is an enlarged view of a heat conductive member (supporting member) of the fixing device illustrated in FIG. 4.

In the heat conductive member 22, as illustrated in FIG. 12, if the lateral edge portion 22*b* remains open after the thin metal plate is bent into the pipe shape, the inherent spring-back of the thin metal plate might enlarge the opening of the lateral edge portion 22*b*. Consequently, the heat conductive member 22 might not contact or press against the fixing belt 21 with uniform pressure.

Hence, at least a part of the lateral edge portion 22*b* in a width direction, that is, an axial direction, of the heat conductive member 22 may be jointed (see joint 22*c*) to prevent the spring-back of the heat conductive member 22 from enlarging the opening of the lateral edge portion 22*b*. For example, an upstream edge 22*e* may be jointed 22*c* with a downstream edge 22*f* by welding.

In the heat conductive member 22 illustrated in FIG. 4, the recessed portion 22*a* is provided to accommodate the nip formation member 26. If the corner portions 22*d* and the nearby portions of the heat conductive member 22 in the recessed portion 22*a* press against the pressing roller 31 via the fixing belt 21, pressure applied by the pressing roller 31 may deform the fixing belt 21 and the heat conductive member 22. Accordingly, the fixing belt 21 and the fixing belt 21 and the heat conductive member 22 may not contact or press against the fixing belt 21 with uniform pressure.

Hence, according to the above-described exemplary embodiments, the heat conductive member 22 including the corner portions 22*d* does not press against the pressing roller 31 via the fixing belt 21. For example, the corner portions 22*d* are provided at positions separated from the fixing nip N so that the corner portions 22*d* are separated from the pressing roller 31.

According to the above-described exemplary embodiments, the fixing device 21 employs the pressing roller 31 as a pressing member. Alternatively, a pressing belt or a pressing pad may be used as the pressing member to provide effects equivalent to the above-described effects provided by the fixing device 20 including the pressing roller 31.

According to the above-described exemplary embodiments, the fixing belt 21 having a multi-layered structure is used as a fixing member. Alternatively, an endless fixing film including polyimide resin, polyamide resin, fluorocarbon resin, and/or thin metal may be used as a fixing member to provide effects equivalent to the above-described effects provided by the fixing device 20 including the fixing belt 21.

The fixing device described above is applicable to a fixing device that fixes images formed according to electrophotographic, electrostatic, or other type of image formation, and to a fixing section of an image forming apparatus, such as a copier, a printer, a facsimile machine, or a multifunctional periphery having at least two of the foregoing capabilities.

The fixing device according to any of the above-described exemplary embodiments adjusts the shape of the fixing nip from the side of the fixing member or the side of the pressing roller, enhancing the fixing performance for recording media.

The image forming apparatus including the fixing device according to any of the above-described exemplary embodiments performs excellent fixing processing as described above, allowing high-quality image formation.

Numerous additional modifications and variations are possible in light of the above teachings. It is therefore to be understood that within the scope of the appended claims, the present disclosure may be practiced otherwise than as specifically described herein.

With some embodiments of the present disclosure having thus been described, it will be obvious that the same may be varied in many ways. Such variations are not to be regarded as a departure from the scope of the present disclosure and appended claims, and all such modifications are intended to be included within the scope of the present disclosure and appended claims.

For example, elements and/or features of different exemplary embodiments may be combined with each other and/or substituted for each other within the scope of this disclosure and appended claims.

What is claimed is:

1. A fixing device comprising:

an endless, rotatable fixing member;

a rotational pressing member rotatably provided in contact with the fixing member;

a nip formation member disposed opposite the rotational pressing member via the fixing member to form a fixing nip between the fixing member and the rotational pressing member; and an urging unit disposed opposite the rotational pressing member via the nip formation member and the fixing member to push against and deform the nip formation member to change a curvature of a contact face between the fixing member and the rotational pressing member at the fixing nip, wherein the urging unit, the rotational pressing member, and the nip formation member satisfy a relation of $$1/r>1/R>1/(r+t)$$

where r represents a radius of the rotational pressing member, 1/r represents a curvature of the fixing nip, R represents a distance between a rotation center of the rotational pressing member and an end portion of the urging unit, 1/R represents a curvature of the end portion of the urging unit, and t represents a thickness of the nip formation member.

2. The fixing device according to claim 1, wherein the urging unit comprises a plurality of urging members to push the nip formation member to change the curvature of the contact face between the fixing member and the rotational pressing member at the fixing nip.

3. The fixing device according to claim 1, wherein the curvature of the contact face between the urging unit and the nip formation member is approximately identical to a curvature of the rotational pressing member.

4. The fixing device according to claim 1, further comprising a driving member that drives the urging unit.

5. The fixing device according to claim 1, further comprising a temperature detector to detect a surface temperature of the rotational pressing member, wherein positioning of the urging unit is controlled in accordance with the surface temperature of the rotational pressing member detected by the temperature detector.

6. The fixing device according to claim 1, wherein the fixing member is an endless belt.

7. The fixing device according to claim 1, further comprising a heater disposed outside the fixing belt.

8. The fixing device according to claim 7, wherein the heater directly heats an outer circumferential portion of the fixing member.

9. The fixing device according to claim 1, wherein the fixing member comprises an endless belt and a supporting member is disposed in contact with an inner circumferential face of the endless belt.

10. The fixing device according to claim 9, further comprising a heater disposed inside the supporting member to heat the fixing member via the supporting member.

11. A fixing device comprising:

endless, rotatable fixing means for fixing an image on a recording medium;

pressing means for rotationally pressing the fixing member;

nip forming means for forming a fixing nip between the fixing means and the pressing means; and urging means for pressing against and deforming the nip forming means to change a curvature of a contact face between the fixing means and the pressing means at the fixing nip wherein the urging unit, the rotational pressing member, and the nip formation member satisfy a relation of $$1/r>1/R>1/(r+t)$$

where r represents a radius of the rotational pressing member, 1/r represents a curvature of the fixing nip, R represents a distance between a rotation center of the rotational pressing member and an end portion of the urging unit, 1/R represents a curvature of the end portion of the urging unit, and t represents a thickness of the nip formation member.

12. An image forming apparatus comprising:

an image forming device that forms an image on a recording medium;

a fixing device that fixes the image, formed by the image forming device, on the recording medium; and a heater that heats the fixing device, the fixing device comprising:

an endless, rotatable fixing member;

a rotational pressing member rotatably provided in contact with the fixing member;

a nip formation member disposed opposite the rotational pressing member via the fixing member to form a fixing nip between the fixing member and the rotational pressing member; and an urging unit disposed opposite the rotational pressing member via the nip formation member and the fixing member to push against and deform the nip formation member to change a curvature of a contact face between the fixing member and the rotational pressing member at the fixing nip, wherein the urging unit, the rotational pressing member, and the nip formation member satisfy a relation of $$1/r>1/R>1/(r+t)$$

where r represents a radius of the rotational pressing member, 1/r represents a curvature of the fixing nip, R represents a distance between a rotation center of the rotational pressing member and an end portion of the urging unit, 1/R represents a curvature of the end portion of the urging unit, and t represents a thickness of the nip formation member.

* * * * *